US010926550B2

(12) United States Patent
Matsubara

(10) Patent No.: US 10,926,550 B2
(45) Date of Patent: Feb. 23, 2021

(54) RECORDING APPARATUS AND METHOD FOR MANAGING RECORDING APPARATUS

(71) Applicant: SEIKO EPSON CORPORATION, Tokyo (JP)

(72) Inventor: Yoshitaka Matsubara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/727,305

(22) Filed: Dec. 26, 2019

(65) Prior Publication Data

US 2020/0207114 A1 Jul. 2, 2020

(30) Foreign Application Priority Data

Dec. 27, 2018 (JP) ..... JP2018-243989

(51) Int. Cl.
*B41J 2/21* (2006.01)

(52) U.S. Cl.
CPC ..... *B41J 2/2103* (2013.01)

(58) Field of Classification Search
CPC ..... B41J 2/2103
See application file for complete search history.

(56) References Cited

U.S. PATENT DOCUMENTS

2019/0009600 A1* 1/2019 Moriguchi ..... B41J 2/175
2019/0132990 A1* 5/2019 Lee ..... G01K 3/08

FOREIGN PATENT DOCUMENTS

JP S62-189149 12/1987
JP H07-199774 8/1995

* cited by examiner

*Primary Examiner* — Lamson D Nguyen
(74) *Attorney, Agent, or Firm* — Workman Nydegger

(57) ABSTRACT

A recording apparatus that performs recording on a recording medium includes a low temperature marker that, depending on a change in temperature, changes a color state to a low-temperature first color state or to a low-temperature second color state different from the low-temperature first color state, and a surface on which the low temperature marker is disposed. The low temperature marker has a characteristic of indicating the low-temperature second color state when a temperature of the low temperature marker is higher than at least the low-temperature first threshold temperature after reached a temperature lower than or equal to a low-temperature first threshold temperature from an initial state indicating the low temperature first color state.

13 Claims, 9 Drawing Sheets

RECORDING APPARATUS AND METHOD FOR MANAGING RECORDING APPARATUS

The present application is based on, and claims priority from JP Application Serial Number 2018-243989, filed Dec. 27, 2018, the disclosure of which is hereby incorporated by reference herein in its entirety.

BACKGROUND

1. Technical Field

The present disclosure relates to a recording apparatus and a method for managing a recording apparatus.

2. Related Art

Ink jet printers, laser printers, and the like are known as recording apparatuses that perform recording on a recording medium. For such a printer, control limits for temperatures, such as an operating environment temperature for normal execution of recording on a recording medium and a storage environment temperature during storage of a printer, are set. Exposing a printer to a temperature outside these limits may cause, for example, in addition to degradation of ink and toner, problems such as faults in a driving section and other components, resulting in a situation where a printer is unable to operate normally. Therefore, for example, JP-UM-A-62-189149 discloses a technique in which a temperature-sensitive label is attached to a printer, and thereby when the printer is being used, the user is notified whether the temperature of the printer is within the operating environment temperature range.

However, a printer that has failed once because of being exposed to a temperature outside the operating environment temperature range or the storage environment temperature range does not always operate properly even if the temperature of the printer during use is within the operating environment temperature range. For example, when a printer exposed to a temperature outside the storage environment temperature range fails, repairs, such as replacement of a failed component, may be made to the printer. However, it is not easy to know that the cause of the failure lies in an environment temperature in the past. When it has not been possible to know the cause, it has been difficult to take measures against the problems.

SUMMARY

According to an embodiment of the present disclosure, a recording apparatus that performs recording on a recording medium is provided. This recording apparatus includes a low temperature marker that, depending on a change in temperature, changes a color state to a low-temperature first color state or to a low-temperature second color state different from the low-temperature first color state, and a surface on which the low temperature marker is disposed. When reaching a temperature lower than or equal to a low-temperature first threshold temperature from the initial state indicating the low-temperature first color state, the low temperature marker may have a characteristic of indicating the low-temperature second color state at a temperature higher than at least the low-temperature first threshold temperature.

DESCRIPTION OF EXEMPLARY EMBODIMENTS

A. First Embodiment

Figure 1:
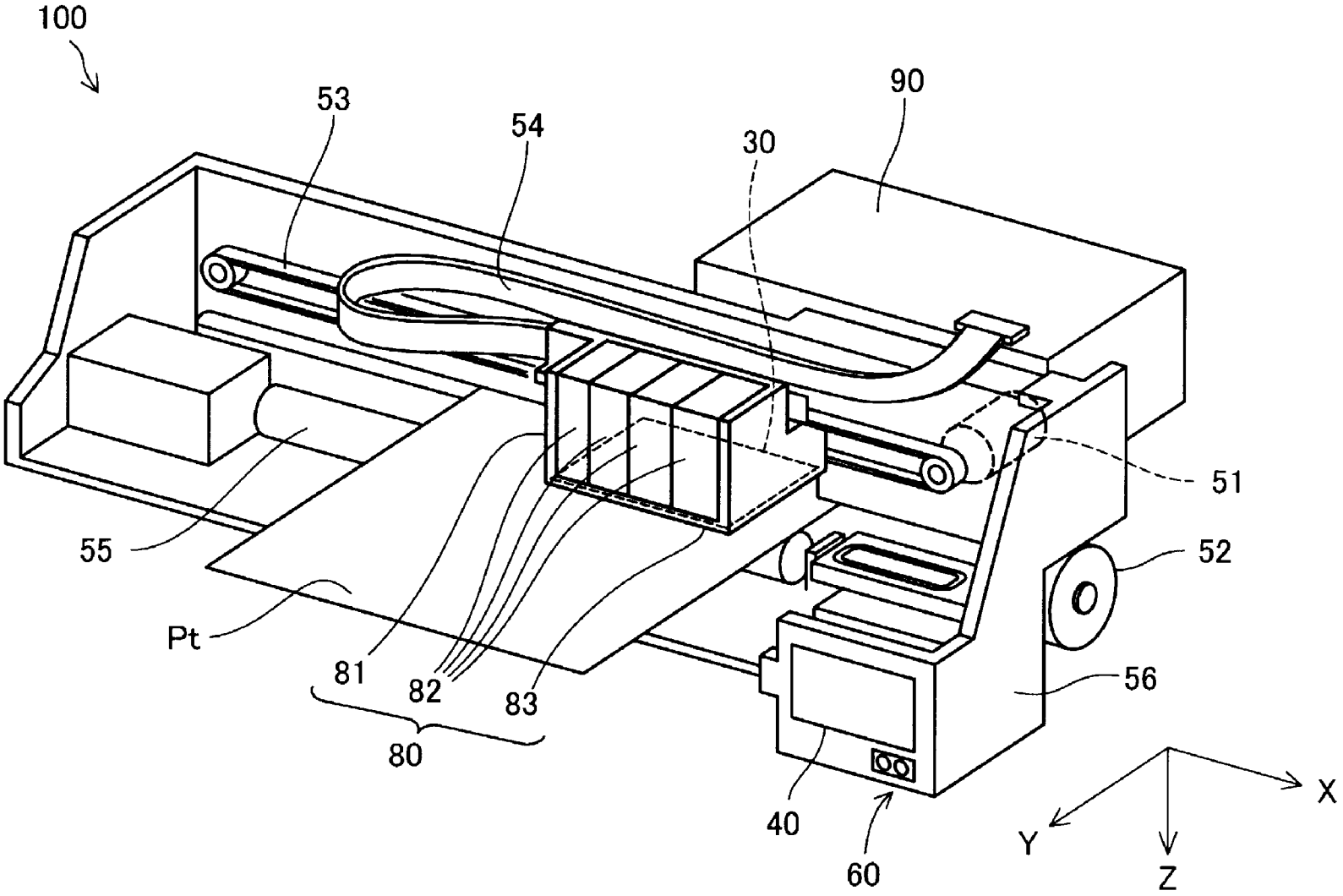
FIG. 1 is a diagram illustrating a schematic configuration of a printing apparatus.

FIG. 1 is a diagram illustrating a schematic configuration of a printing apparatus 100. The printing apparatus 100 is a serial ink jet printer, which is an example of a recording apparatus. The printing apparatus 100 forms dots on a recording medium Pt, such as printing paper, by discharging ink, which is liquid, based on printing data input from an image forming device, to perform printing. In FIG. 1, the X-, Y-, and Z-directions are indicated. The X-direction is a direction along a main scanning direction, which is the width direction of the recording medium Pt, and the Y-direction is a direction along a sub-scanning direction, which is a transport direction of the recording medium Pt. The Z-direction is a direction along the direction of gravity and is a direction in which a liquid discharge head 83 according to the present embodiment discharges ink.

A head unit 80, which is an ink discharge unit of the printing apparatus 100, includes a carriage 81, ink cartridges 82, and the liquid discharge head 83. The head unit 80 is electrically coupled to a control section 90 via a flexible cable 54. The head unit 80, which is attached to a carriage guide (not illustrated), moves backward and forward along the X-direction, which is the main scanning direction, by the motive power of a carriage motor 51 transmitted via a drive belt 53.

On the carriage 81, a plurality of ink cartridges 82 of respective types of ink are mounted. In the present embodiment, the ink cartridges 82 of four types, cyan (Cy), magenta (Ma), yellow (Ye), and black (Bk), are provided. In addition, as well as light cyan (Lc) and light magenta (Lm), various types of white ink (Wt), such as pearl white to which metallic luster is added, and transparent ink (Op) that is used for adjustment of luster of an printed image and for a printing pretreatment may further be used.

The liquid discharge head 83 includes a nozzle formation surface 30 on the Z-direction side thereof, which is the side of the surface facing the recording medium Pt. On the nozzle formation surface 30, head chips corresponding to the respective types of ink mentioned above are provided. Each head chip is provided with a plurality of nozzles, which are openings that discharge ink droplets. The number and arrangement of nozzles may be set in any manner in accordance with the resolution and the like of the printing apparatus 100. The liquid discharge head 83 is coupled to the carriage 81 and, while moving backward and forward along the X-direction, discharges ink from nozzles of the nozzle formation surface 30 toward the recording medium Pt.

A transport motor 52 performs driving in response to control signals from the control section 90. Rotating a platen 55 by the motive power of the transport motor 52 transports the recording medium Pt along the Y-direction, which is the sub-scanning direction. In the present embodiment, the sub-scanning direction is at right angles to the main-scanning direction; however, the sub-scanning direction is not limited to being at right angles and may intersect at any angle.

The control section 90, which includes a memory and a central processing unit (CPU), performs control over the entire printing apparatus 100. The control section 90 transmits and receives data to and from an image formation device via an interface (not illustrated) and outputs a drive signal to the liquid discharge head 83. The drive signal causes ink to be discharged from nozzles provided in the liquid discharge head 83. When print data is output from the image formation device, the control section 90 drives the carriage motor 51 to cause the head unit 80 to move backward and forward along the X-direction. The control section 90 alternatively repeats control for discharging ink onto the recording medium Pt by using the liquid discharge head 83 and control for transporting the recording medium Pt along the Y-direction by using the transport motor 52, thereby printing an image on the recording medium Pt.

A panel 40 is provided on the Y-direction side of a housing 56 of the printing apparatus 100, that is, the front side of the printing apparatus 100 and is an image display section that displays various types of information of the printing apparatus 100, such as an error message and a remaining ink amount, to a user. In the present embodiment, a touch panel is employed as the panel 40, and a user may control components of the printing apparatus 100 by operating the panel 40.

For the printing apparatus 100 according to the present embodiment, an operating environment temperature and a storage environment temperature are set. The operating environment temperature is, for example, a range of temperature for properly performing recording on the recording medium Pt by the printing apparatus 100 without causing a problem in the color development or viscosity of ink or in the performance of the control section 90 or the discharge performance of the liquid discharge head 83. The storage environment temperature is a range of temperature set for, in addition to maintaining the performances of ink and the liquid discharge head 83, suppressing condensation and degradation in components such as a driving section and thus properly storing the printing apparatus 100 during the non-operating time. The operating environment temperature and the storage environment temperature are set to any values in accordance with the type of a recording apparatus, the material of each component, and the like. In the present embodiment, the operating environment temperature is set in a range from 10° C. to 35° C. and the storage environment temperature is set in a range from 0° C. to 40° C. The operating environment temperature and the storage environment temperature are described in the user manual, equipment specifications, and the like of the printing apparatus 100 and are presented to a user, an administrator, and the like of the printing apparatus 100, and therefore the operating environment temperature is also referred to as a nominal operating environment temperature and the storage environment temperature is also referred to as a nominal storage environment temperature. Usually, the temperature range set as the nominal storage environment temperature is the setting for the printing apparatus 100 during the non-operating time and therefore includes the temperature range of the nominal operating environment temperature and is set in a temperature range broader than the temperature range of the nominal operating environment temperature.

With reference to FIG. 2 to FIG. 6 as well as FIG. 1, the details of a color state display section 60 included in the housing 56 of the printing apparatus 100 according to the present embodiment will now be described. As illustrated in FIG. 1, the color state display section 60 is attached at a lower location of the panel 40 on the front side of the housing 56 of the printing apparatus 100.

Figure 2:
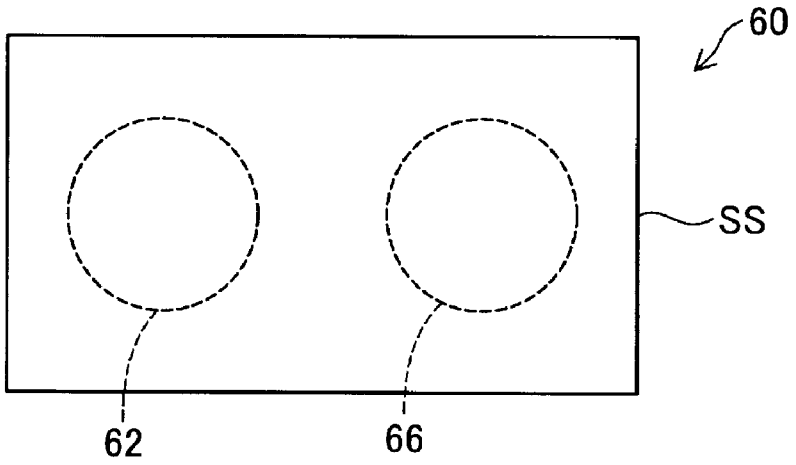
FIG. 2 is a front view illustrating a color state display section.

FIG. 2 is a front view illustrating the color state display section 60 including a low temperature marker 62 and a high temperature marker 66. As illustrated in FIG. 2, in the color state display section 60, two types of markers, the low temperature marker 62 and the high temperature marker 66, are disposed adjacent to each other on the surface of a sealing sheet SS. The sealing sheet SS is a paper medium and constitutes a surface on which the low temperature marker 62 and the high temperature marker 66 are disposed. The sealing sheet SS is attached together with the color state display section 60 onto the housing 56 by an adhesive material, such as paste, applied to a surface of the sealing sheet SS opposite the surface including the color state display section 60. The sealing sheet SS is not limited to a paper medium and may be made of various materials, such as plastic, constituting a surface for inclusion of the low temperature marker 62 and the high temperature marker 66.

The low temperature marker 62 and the high temperature marker 66 are made of ink in which a reversible thermochromic pigment is dispersed in a liquid, a so-called reversible thermochromic ink, and reversibly change the color states depending on temperature change. The reversible thermochromic pigment is an encapsulated pigment in which a color former such as a leuco dye, a developer that chemically combines with a color former to achieve color development, and a color change temperature regulator that chemically combines with the developer in accordance with temperature are contained. By changing the kind of the color change temperature regulator, the transition points and threshold temperatures described later of the low temperature marker 62 and the high temperature marker 66 are adjusted. "Color state" refers to the density of a color and the visual state including hue, brightness, colorfulness, and luster. In the present embodiment, depending on a change in temperature, the low temperature marker 62 reversibly changes the color state between a low-temperature first color state indicating transparency and a low-temperature second color state indicating blue. In the present embodiment, depending on a change in temperature, the high temperature marker 66 reversibly changes the color state between a high-temperature first color state indicating transparency and a high-temperature second color state indicating red. In FIG. 2, both the color states of the low temperature marker 62 and the high temperature marker 66 indicate transparency, and the low temperature marker 62 in the low-temperature first color state and the high temperature marker 66 in the high-temperature first color state are schematically illustrated.

Figure 3:
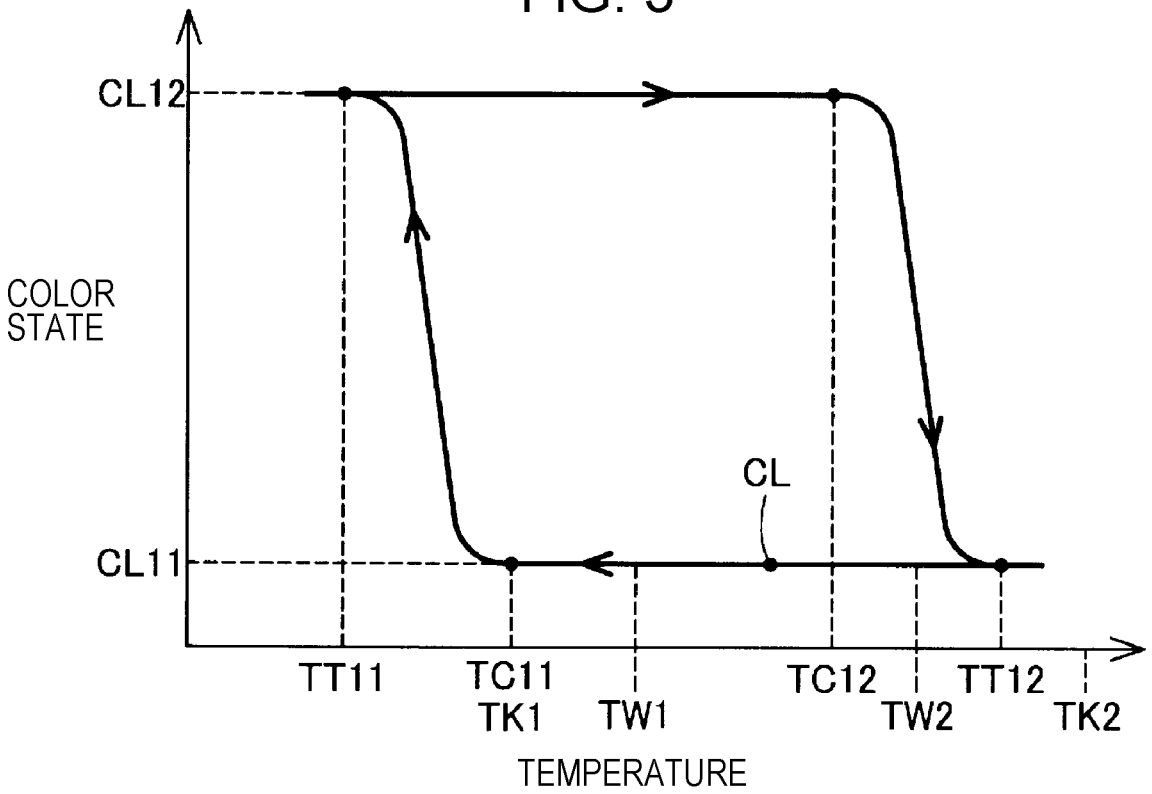
FIG. 3 is a graph illustrating a change in the color state of a low temperature marker with respect to a change in temperature.
Figure 4:
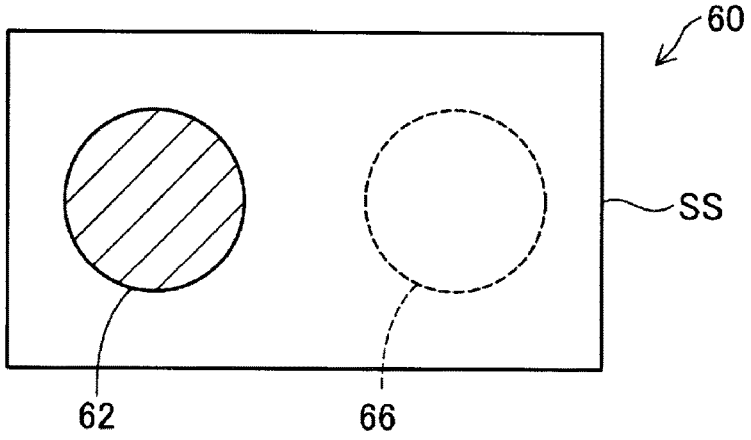
FIG. 4 is a front view illustrating a low temperature marker whose state has been changed to a low-temperature second color state.

With reference to FIG. 3 and FIG. 4, a change in the color state of the low temperature marker 62 will now be described. FIG. 3 is a graph illustrating a change in the color state of the low temperature marker 62 with respect to a change in temperature. The vertical axis represents the color state of the low temperature marker 62, and the horizontal axis represents temperature. On the horizontal axis of FIG. 3, a lower limit value TW1 (10° C.) and an upper limit value TW2 (35° C.) of the operating environment temperature of the printing apparatus 100 described above and a lower limit value TK1 (0° C.) and an upper limit value TK2 (40° C.) of the storage environment temperature are represented.

As described above, depending on a temperature change, the low temperature marker 62 reversibly changes the color state between a low-temperature first color state CL11 indicating transparency and a low-temperature second color state CL12 indicating blue. When room temperature RT is set at 25° C., the initial state in which the low temperature marker 62 is in the low-temperature first color state CL11 at the room temperature RT is assumed as a state CL illustrated in FIG. 3. For example, when the temperature of the low temperature marker 62 in the state CL is decreased below the room temperature RT and exceeds a transition point TC11, the low temperature marker 62 begins to change the color state to the low-temperature second color state CL12. When the temperature of the low temperature marker 62 is further decreased, on the occasion of reaching a temperature TT11, the change of the color state of the low temperature marker 62 to the low-temperature second color state CL12 is complete. The temperature TT11 at which the color state of the low temperature marker 62 changes from the low-temperature first color state CL11 to the low-temperature second color state CL12 is also referred to as a low-temperature first threshold temperature TT11. In the present embodiment, the low-temperature first threshold temperature TT11 is −5° C., which is set to be lower than the lower limit value TK1 (0° C.) of the storage environment temperature.

FIG. 4 is a front view of the color state display section 60, illustrating the low temperature marker 62 whose state has been changed to the low-temperature second color state CL12. As illustrated in FIG. 4, the low temperature marker 62 that is transparent in the low-temperature first color state CL11 at the room temperature RT changes to the low-temperature second color state CL12 indicating blue when reaching a temperature less than or equal to the low-temperature first threshold temperature TT11, providing the user with the state that enables visual recognition of the change.

As illustrated in FIG. 3, the low temperature marker 62, which, upon reaching the low-temperature first threshold temperature TT11, has changed to the low-temperature second color state CL12, exceeds a transition point TC12 and begins to change the color state to the low-temperature first color state CL11 when experiencing a temperature rise. When the temperature of the low temperature marker 62 is further raised, on the occasion of reaching a temperature TT12, the color state of the low temperature marker 62 changes again to the low-temperature first color state CL11. Then, even when the temperature of the low temperature marker 62 is decreased to the room temperature RT, the low temperature marker 62 maintains the low-temperature first color state CL11. The temperature TT12 at which the color state of the low temperature marker 62 changes from the low-temperature second color state CL12 to the low-temperature first color state CL11 is also referred to as a low-temperature second threshold temperature TT12. In the present embodiment, the low-temperature second threshold temperature TT12 is 37° C., which is set to be higher than the upper limit value TW2 (35° C.) of the operating environment temperature and to be lower than the upper limit value TK2 (40° C.) of the storage environment temperature.

Figure 5:
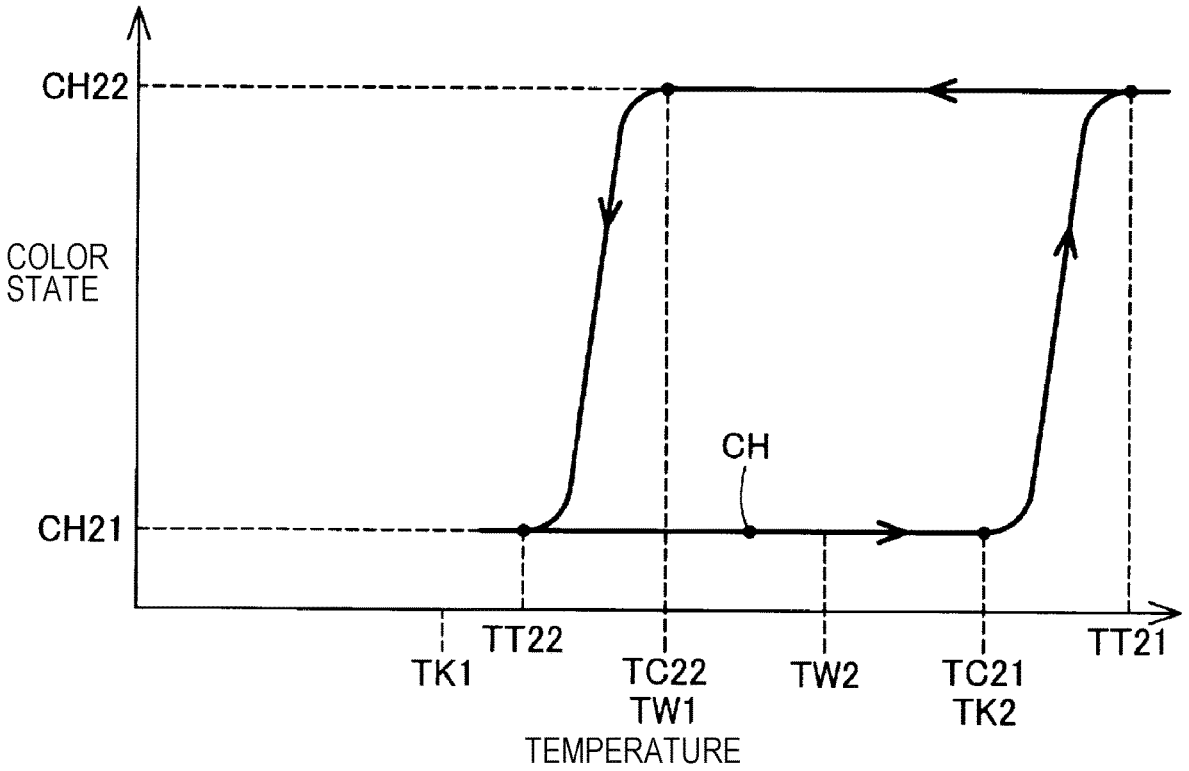
FIG. 5 is a graph illustrating a change in the color state of a high temperature marker with respect to a change in temperature.
Figure 6:
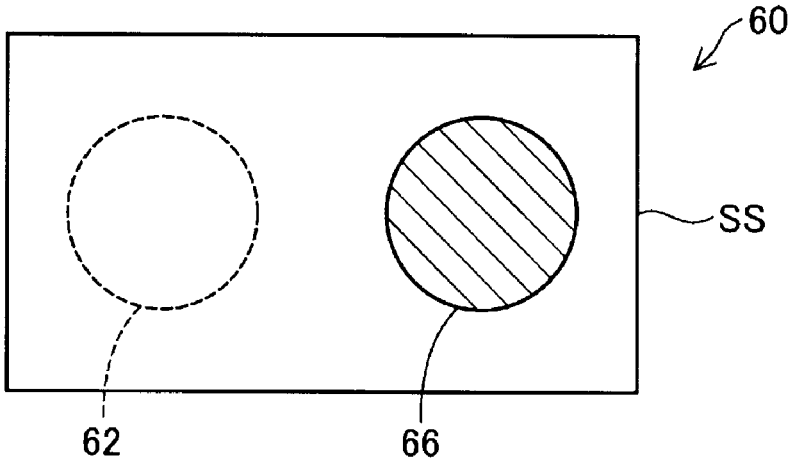
FIG. 6 is a front view illustrating a high temperature marker whose state has been changed to a high-temperature second color state.

With reference to FIG. 5 and FIG. 6, a change in the color state of the high temperature marker 66 will now be described. FIG. 5 is a graph illustrating a change in the color state of the high temperature marker 66 with respect to a change in temperature. The vertical axis represents the color state of the high temperature marker 66 and the horizontal axis represents temperature.

As described above, depending on the temperature change, the high temperature marker 66 reversibly changes the color state between a high-temperature first color state CH21 indicating transparency and a high-temperature second color state CH22 indicating red. When the room temperature RT is set at 25° C., the state of the high temperature marker 66, which is the high-temperature first color state CH21 at the room temperature RT, is assumed as a state CH illustrated in FIG. 5. For example, when the temperature of the high temperature marker 66 in the state CH is raised higher than the room temperature RT and exceeds the transition point TC21, the high temperature marker 66 begins to change the color state to the high-temperature second color state CH22. When the temperature of the high temperature marker 66 is further raised, on the occasion of reaching a temperature TT21, the color state of the high temperature marker 66 completes changing to the high-temperature second color state CH22. The temperature TT21 at which the color state of the high temperature marker 66 changes from the high-temperature first color state CH21 to the high-temperature second color state CH22 is also referred to as a high-temperature first threshold temperature TT21. In the present embodiment, the high-temperature first threshold temperature TT21 is 45° C., which is set to be higher than the upper limit value TK2 (40° C.) of the storage environment temperature.

FIG. 6 is a front view illustrating the high temperature marker 66 whose state has been changed to the high-temperature second color state CH22. The high temperature marker 66 that is transparent in the high-temperature first color state CH21 at the room temperature RT changes to the high-temperature second color state CH22 indicating red when reaching a temperature higher than or equal to the high-temperature first threshold temperature TT21, providing the user with the state that enables visual recognition of the change.

As illustrated in FIG. 5, the high temperature marker 66, which, upon reaching the high-temperature first threshold temperature TT21, has changed to the high-temperature second color state CH22, exceeds a transition point TC22 and begins to change the color state to the high-temperature first color state CH21 when experiencing a temperature decrease. When the temperature of the high temperature marker 66 is further decreased, on the occasion of reaching a high-temperature second threshold temperature TT22, the color state of the high temperature marker 66 changes to the high-temperature first color state CH21. Then, the high temperature marker 66 maintains the high-temperature first color state CH21 even when the temperature is raised to the room temperature RT. A temperature TT22 at which the color state of the high temperature marker 66 changes from the high-temperature second color state CH22 to the high-temperature first color state CH21 is also referred to as the high-temperature second threshold temperature TT22. In the present embodiment, the high-temperature second threshold temperature TT22 is 5° C., which is set to be lower than the lower limit value TW1 (10° C.) of the operating environment temperature and be higher than the lower limit value TK1 (0° C.) of the storage environment temperature.

Figure 7:
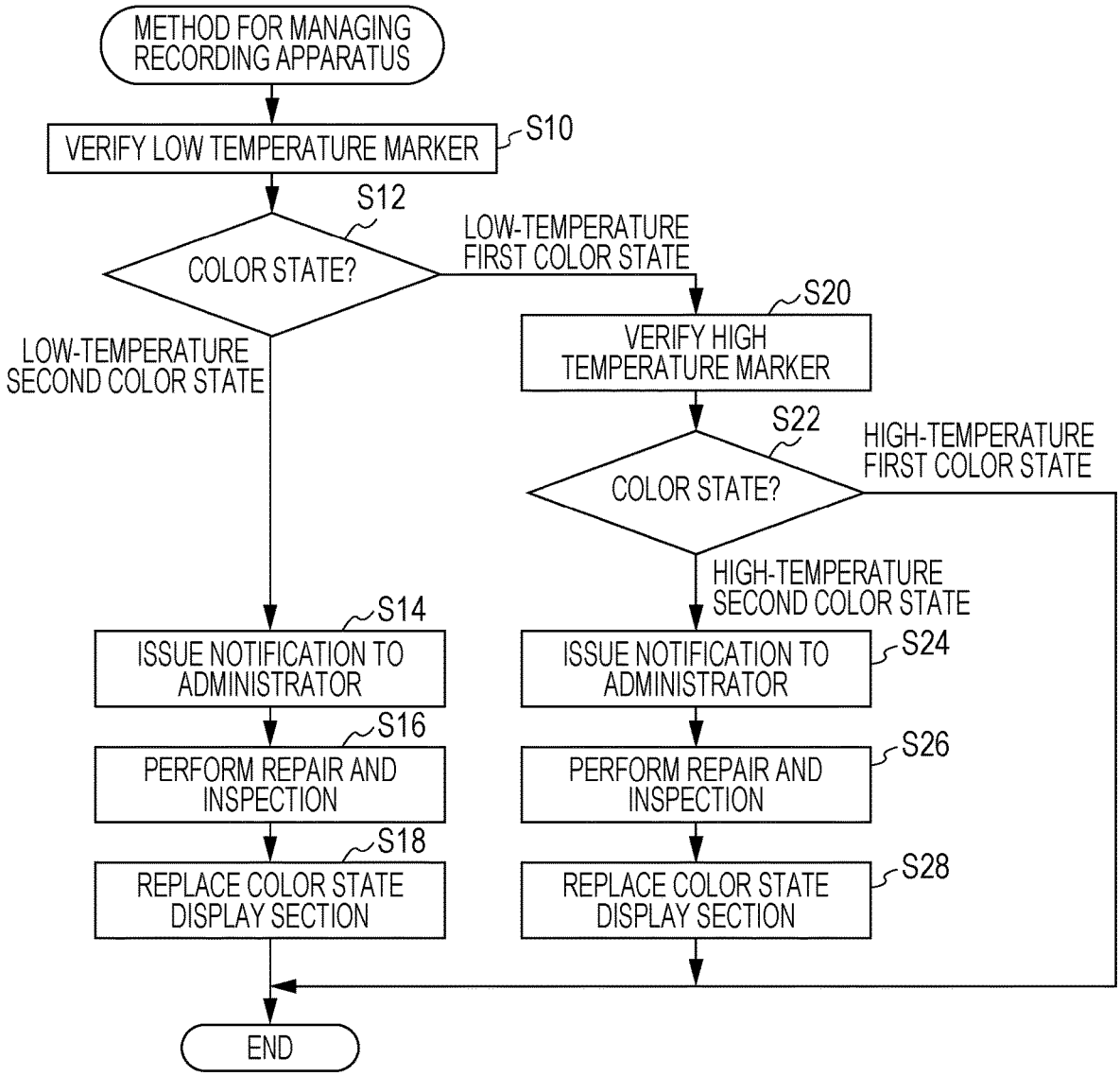
FIG. 7 is a process diagram illustrating a method for managing a printing apparatus.

With reference to FIG. 7, a method for managing the printing apparatus 100 according to the present embodiment will now be described. FIG. 7 is a process diagram illustrating a method for managing the printing apparatus 100. The method for managing the printing apparatus 100 according to the present embodiment begins, for example, by powering on the printing apparatus 100.

In step S10, the powered on printing apparatus 100 presents, on the panel 40, a display indicating that the state of the low temperature marker 62 will be verified, to provide a notification to the user. In step S12, the user visually verifies the color state of the low temperature marker 62 of the color state display section 60 and inputs to the panel 40 a verification result, that is, whether the color state of the low temperature marker 62 is the low-temperature first color state CL11 or the low-temperature second color state CL12. If the color state of the low temperature marker 62 is the low-temperature second color state CL12 (S12: the low-temperature second color state), that is, if the low temperature marker 62 indicates blue, in step S14, the user issues a notification to an administrator of the printing apparatus 100. The administrator includes, besides a sales company and a manufacturer of the printing apparatus 100, various persons capable of performing inspection and repair of the printing apparatus 100, such as a serviceman. Notification to the administrator is made by the user and may also be made in various ways; for example, the control section 90 that has received input of a check result from the user notifies the administrator via a network. This way allows notification to the administrator to be complete early, allowing the printing apparatus 100 to be restored early.

In step S16, the notified administrator inspects the printing apparatus 100 and, if required, repairs damage. In step S18, after completing repair and inspection, the administrator peels off the color state display section 60 together with the sealing sheet SS from the printing apparatus 100 and replaces the color state display section 60 with a new one, and thus this step is complete.

In contrast, if, in step S12, the color state of the low temperature marker 62 of the color state display section 60 is the low-temperature first color state CL11 (S12: the low-temperature first color state), that is, the low temperature marker 62 indicates transparency, in step S20, the printing apparatus 100 presents, on the panel 40, a display indicating that the state of the high temperature marker 66 will be verified, to provide a notification to the user. In step S22, the user inputs to the panel 40 a result of visually verifying the color state of the high temperature marker 66 of the color state display section 60, that is, a result of verifying whether the color state of the high temperature marker 66 is the high-temperature first color state CH21 or the high-temperature second color state CH22. If the color state of the high temperature marker 66 is the high-temperature second color state CH22 (S22: high-temperature second color state), that is, the high temperature marker 66 indicates red, in step S24, the user issues a notification to the administrator of the printing apparatus 100. In step S26, the notified administrator inspects the printing apparatus 100 and, if required, repairs damage. In step S28, after completing repair and inspection, the administrator peels off the color state display section 60 together with the sealing sheet SS from the printing apparatus 100 and replaces the color state display section 60 with a new one, and thus this step is complete. In step S22, if the color state of the high temperature marker 66 is the high-temperature first color state CH21 (S22: high-temperature first color state), that is, if the high temperature marker 66 indicates transparency, this step is completed.

As described above, with the printing apparatus 100 according to the present embodiment, the low temperature marker 62, which has indicated the low-temperature first color state CL11 at a temperature higher than the low-temperature first threshold temperature TT11, indicates the low-temperature second color state CL12 of blue when, after reaching a temperature lower than or equal to the low-temperature first threshold temperature TT11, reaching a temperature higher than the low-temperature first threshold temperature TT11. Thereby, by using the color state of the low temperature marker 62, the user may visually recognize a change in the environment temperature in the past of decreasing below the low-temperature first threshold temperature TT11 on the low temperature side.

In the printing apparatus 100 according to the present embodiment, the low-temperature first threshold temperature TT11 is set to a temperature lower than the lower limit value TK1 of the nominal storage environment temperature of the printing apparatus 100. Thereby, by using the low temperature marker 62, the user may visually recognize a change in the environment temperature in the past of decreasing below the lower limit value TK1 of the nominal storage environment temperature.

With the printing apparatus 100 according to the present embodiment, since the low-temperature first threshold temperature TT11 of the low temperature marker 62 is set to a temperature lower than 0° C., by using the low temperature marker 62, the user may visually recognize that the printing apparatus 100 is exposed to a low temperature that is highly likely to affect the printing apparatus 100.

With the printing apparatus 100 according to the present embodiment, the low-temperature second threshold temperature TT12 of the low temperature marker 62 is set as a temperature higher than the upper limit value TW2 of the nominal operating environment temperature of the printing apparatus 100. Therefore, a problem in which the color state of the low temperature marker 62 changes while the printing apparatus 100 is within the range of the nominal operating environment temperature, that is, while the printing apparatus 100 is in operation may be avoided.

With the printing apparatus 100 according to the present embodiment, when the high temperature marker 66 indicating the high-temperature first color state CH21 reaches a temperature higher than or equal to the high-temperature first threshold temperature TT21 and then reaches a temperature lower than the high-temperature first threshold temperature TT21, the high temperature marker 66 indicates the high-temperature second color state CH22 in red. Thereby, by using the high temperature marker 66, the user may visually recognize a change in the environment temperature in the past of rising above the high-temperature first threshold temperature TT21 on the high temperature side.

In the printing apparatus 100 according to the present embodiment, the high-temperature first threshold temperature TT21 is set at a temperature higher than the upper limit value TK2 of the nominal storage environment temperature. Thereby, by using the high temperature marker 66, the user may visually recognize a change in the environment temperature in the past of rising above the upper limit value TK2 of the nominal storage environment temperature.

With the printing apparatus 100 according to the present embodiment, the high-temperature first threshold temperature TT21 of the high temperature marker 66 is set to a temperature higher than 40° C., and therefore, by using the high temperature marker 66, the user may visually recognize that the printing apparatus 100 is exposed to a high temperature that is highly likely to affect the printing apparatus 100.

With the printing apparatus 100 according to the present embodiment, the high-temperature second threshold temperature TT22 of the high temperature marker 66 is set as a temperature lower than the lower limit value TW1 of the nominal operating environment temperature of the printing apparatus 100, and therefore a problem in which the color state of the high temperature marker 66 changes while the printing apparatus 100 is within the range of the nominal operating environment temperature, that is, while the printing apparatus 100 is in operation may be avoided.

B. Second Embodiment

Figure 8:
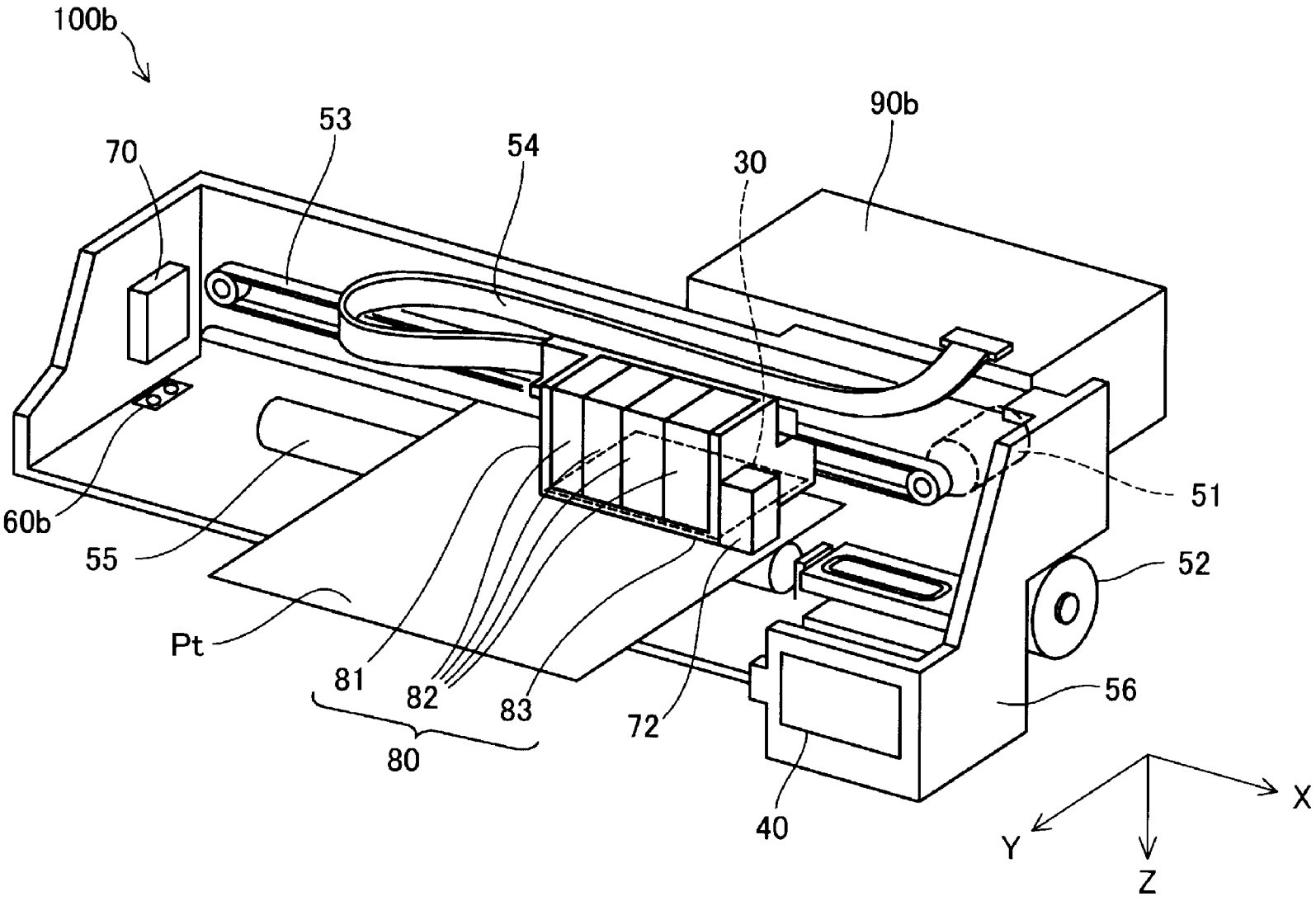
FIG. 8 is a diagram illustrating a schematic configuration of a printing apparatus according to a second embodiment.

FIG. 8 is a schematic configuration diagram of a printing apparatus 100*b* according to a second embodiment. The printing apparatus 100*b* according to the second embodiment differs from the printing apparatus 100 according to the first embodiment in including a color state display section 60*b*, in place of the color state display section 60, in the housing 56, including a control section 90*b* in place of the control section 90, and further including a color state obtaining section 70 and a record obtaining section 72. The configuration of the other components is the same as that of the printing apparatus 100 according to the first embodiment.

The color state obtaining section 70 is a camera that captures images of the low temperature marker 62 and the high temperature marker 66 of the color state display section 60*b* to obtain respective images of the markers 62, 66. The images obtained by the color state obtaining section 70 are output to the control section 90*b*.

The record obtaining section 72 is a camera provided on a side surface on the X-axis direction side of the carriage 81. The record obtaining section 72 obtains an image formed on the recording medium Pt by the printing apparatus 100*b*. The image obtained by the record obtaining section 72 is output to the control section 90*b*.

Figure 9:
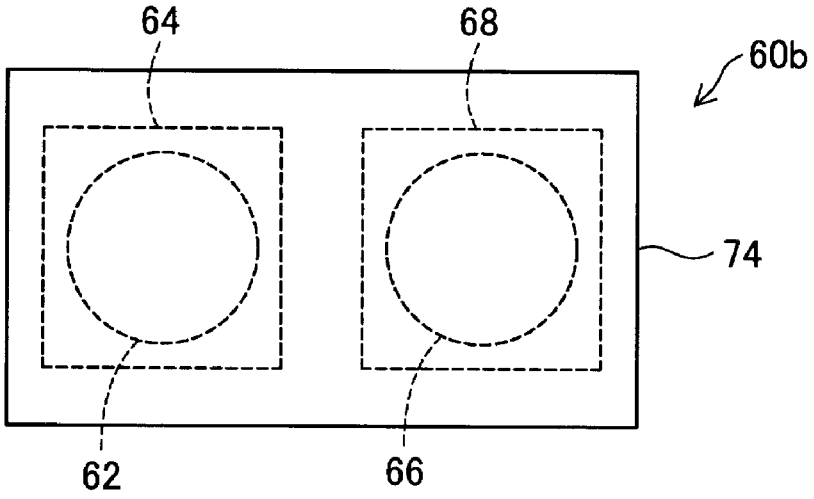
FIG. 9 is a front view illustrating a color state display section according to the second embodiment.

With reference to FIG. 9, the details of the color state display section 60*b* included in the printing apparatus 100*b* according to the second embodiment will now be described. FIG. 9 is a front view illustrating the color state display section 60*b* included in the printing apparatus 100*b* according to the second embodiment. The color state display section 60*b* includes the low temperature marker 62 and the high temperature marker 66, like the color state display section 60 according to the first embodiment, and also includes a temperature adjustment section 74 instead of the sealing sheet SS according to the first embodiment.

The temperature adjustment section 74 constitutes a surface for disposing the low temperature marker 62 and the high temperature marker 66 and includes a heater 64 made of a typical heater and a cooler 68 made of a Peltier device. In the present embodiment, the heater 64 is disposed on the back surface side of the low temperature marker 62 and the cooler 68 is disposed on the back surface side of the high temperature marker 66. In such a manner, the temperature adjustment section 74 is set to allow increasing of the temperature of the low temperature marker 62 and cooling of the high temperature marker 66 to be individually performed under control of the control section 90*b*. The temperature adjustment section 74 may be configured such that increasing of the temperature of the low temperature marker 62 and cooling of the high temperature marker 66 are individually performed by a single Peltier device.

Figure 10:
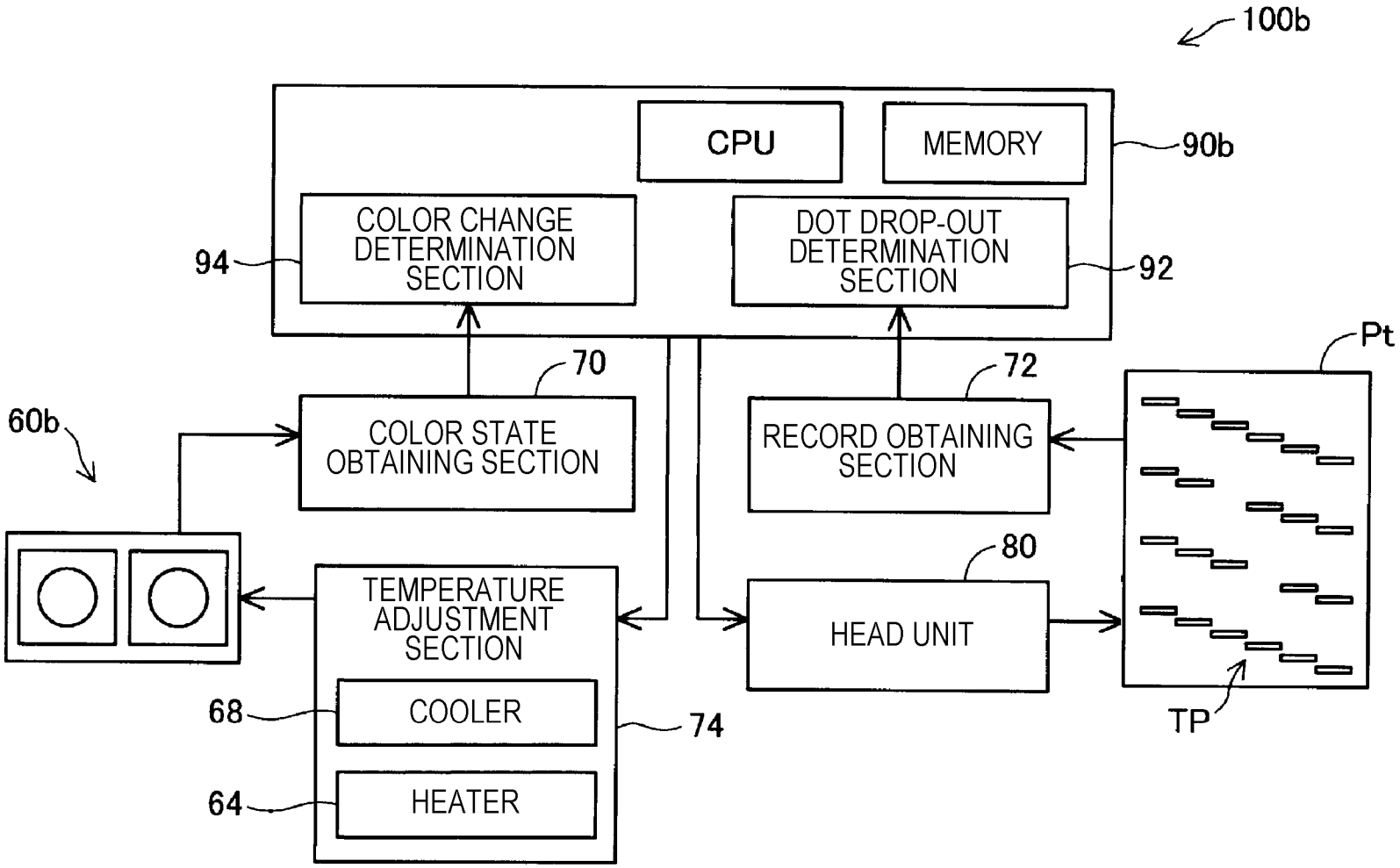
FIG. 10 is a block diagram schematically illustrating a configuration of a control section and components.

With reference to FIG. 10, the details of the control section 90*b* included in the printing apparatus 100*b* according to the second embodiment will now be described. FIG. 10 is a block diagram schematically illustrating the configuration of the control section 90*b* and components included in the printing device 100*b* according to the second embodiment. The control section 90*b* according to the second embodiment includes, in addition to the configuration of the control section 90 according to the first embodiment a dot omission determination section 92, and a color change determination section 94. The control section 90*b* achieves functions of the dot omission determination section 92 and the color change determination section 94 when the CPU reads a program stored in advance in the memory.

The dot omission determination section 92 determines from an image on the recording medium Pt obtained by the record obtaining section 72 whether there is an abnormality in the liquid discharge head 83. As illustrated in FIG. 10, a test pattern TP in which respective raster lines of nozzles are formed is used for determination made by the dot omission determination section 92. The test pattern TP is formed on the recording medium Pt by the liquid discharge head 83 of the head unit 80. The formed test pattern TP is obtained as an image by the record obtaining section 72. The dot omission determination section 92 verifies raster lines from the image obtained by the record obtaining section 72 and determines that there is a nozzle clogging abnormality in a nozzle corresponding to a location at which the raster line is not ascertained. This nozzle clogging abnormality is also referred to as a dot omission.

The color change determination section 94 binarizes images of the low temperature marker 62 and the high temperature marker 66 obtained by the color state obtaining section 70, detects respective edges of the markers 62, 66, and determines the color states. The color change determination section 94 may determine the color states by detecting the color densities, brightnesses, colorfulnesses, and hues in addition to the edges of the markers 62, 66.

Figure 11:
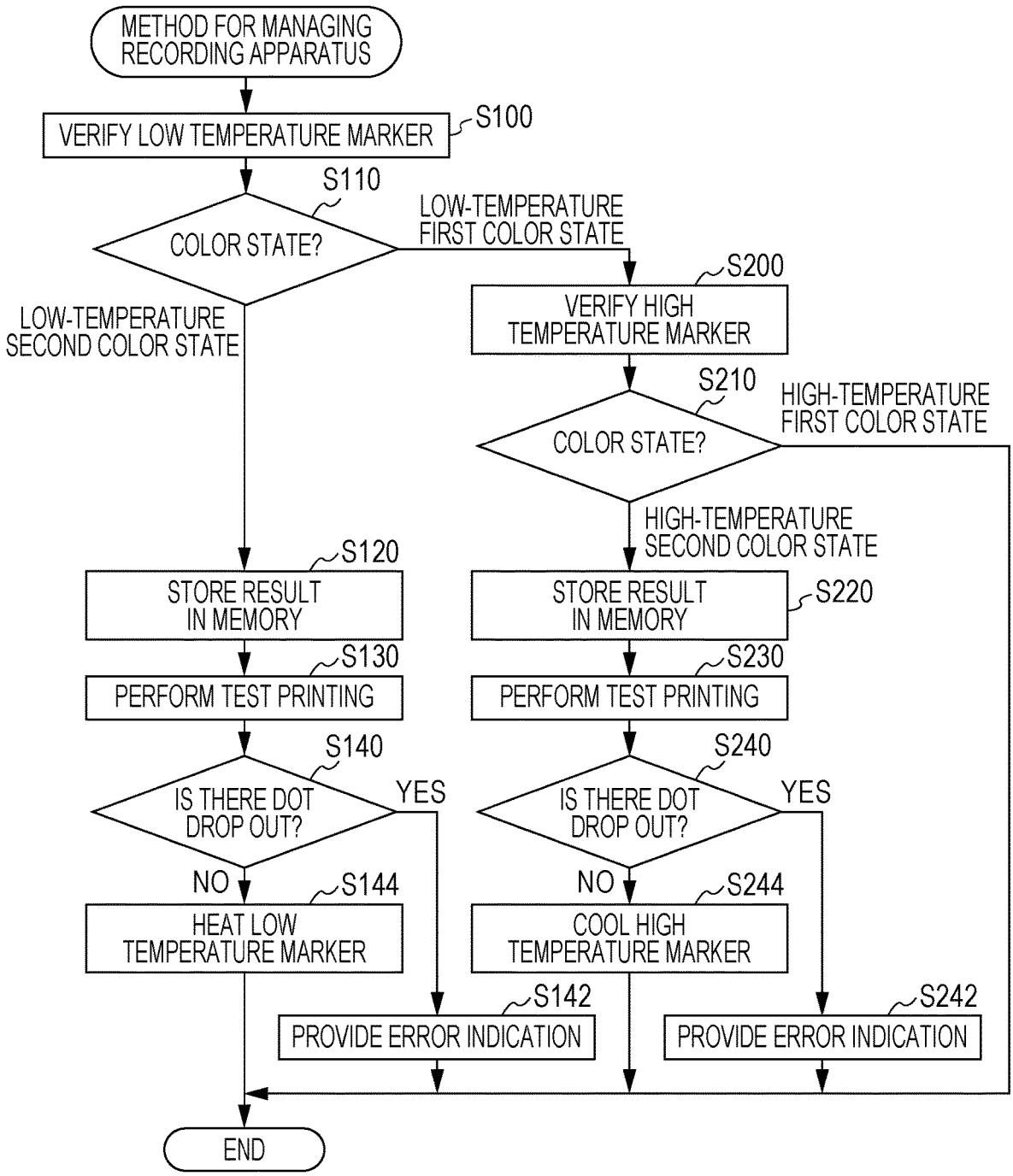
FIG. 11 is a flow diagram executed by a control section of a printing apparatus according to the second embodiment.

With reference to FIG. 11, a method for managing the printing apparatus 100*b* that is performed by the printing apparatus 100*b* according to the second embodiment will now be described. FIG. 11 is a flow diagram executed by the control section 90*b* of the printing apparatus 100*b* according to the second embodiment. The method for managing the printing apparatus 100*b* according to the present embodiment begins, for example, by powering on the printing apparatus 100*b*.

In step S100, the powered on printing apparatus 100*b* obtains an image of the low temperature marker 62 by using the color state obtaining section 70. In step S110, the color change determination section 94 performs edge detection of the low temperature marker 62 from the obtained image and determines the color state of the low temperature marker 62. If the low temperature marker 62 indicates blue, which is the low-temperature second color state CL12, the color change determination section 94 recognizes the low temperature marker 62 by edge detection and determines that the low temperature marker 62 is in the low-temperature second color state CL12 (S110: low-temperature second color state). In contrast, if the color change determination section 94 is unable to detect edges, the color change determination section 94 determines that the low temperature marker 62 is in the low-temperature first color state CL11 (S110: low-temperature first color state).

If it is determined that the low temperature marker 62 is in the low-temperature second color state CL12 (S110: low-temperature second color state), in step S120, the control section 90*b* causes the result to be stored in the memory such that the result is left as a history. In step S130, the control section 90*b* controls the head unit 80 to perform test printing of forming the test pattern TP on the recording medium Pt. In step S140, the record obtaining section 72 obtains an image of the test pattern TP and outputs the image to the dot omission determination section 92. Upon receiving the image, the dot omission determination section 92 verifies raster lines respectively corresponding to nozzles and determines whether there is a dot omission in the liquid discharge head 83. If it is determined that there is a dot omission (S140: YES), the process proceeds to S142, where the control section 90*b* provides the panel 40 with an error indication indicating that there is an abnormality in the liquid discharge head 83, and thus this flow is complete. The control section 90*b* may provide, together with the error indication, communication to the administrator of the printing apparatus 100*b* via a network or the like to automatically issue a notification that there is an abnormality in the printing apparatus 100*b*. If the dot omission determination section 92 determines that there is not a dot omission (S140: NO), the process proceeds to step S144. In step S144, the control section 90*b* controls the heater 64 of the temperature adjustment section 74 to heat the low temperature marker 62. At this point, a target temperature to which the low temperature marker 62 is to be raised is 37° C., which is the low-temperature second threshold temperature TT12 of the low temperature marker 62. The low temperature marker 62 of the low-temperature second color state CL12 changes the color state to the low-temperature first color state CL11, which is transparent, and thus this flow is complete.

In contrast, if, in step S110, it is determined that the low temperature marker 62 is in the low-temperature first color state CL11 (S110: low-temperature first color state), the process proceeds to step S200, where the color state obtaining section 70 obtains an image of the high temperature marker 66 and outputs the image to the control section 90*b*. In step S210, the color change determination section 94 performs edge detection of the high temperature marker 66 from the obtained image and determines the color state of the high temperature marker 66. When the high temperature marker 66 indicates red, which is the high-temperature second color state CH22, the color change determination section 94 recognizes the high temperature marker 66 by edge detection and determines that the high temperature marker 66 is in the high-temperature second color state CH22 (S210: high-temperature second color state). In contrast, when edges are unable to be detected, the color state determination section 94 determines that the high temperature marker 66 is in the high-temperature first color state CH21 (S210: high-temperature first color state), and thus this flow is complete.

In step S210, if it is determined that the high temperature marker 66 is in the high-temperature second color state CH22 (S210: high-temperature second color state), in step S220, the control section 90*b* causes the result to be stored in the memory such that the result is left as a history. In step S230, the control section 90*b* controls the head unit 80 to perform test printing of forming the test pattern TP on the recording medium Pt. In step S240, the dot omission determination section 92 determines from the test pattern TP obtained by the record obtaining section 72 whether there is a dot omission in the liquid discharge head 83. If it is determined that there is a dot omission (S240: YES), the process proceeds to step S242, where the control section 90*b* provides the panel 40 with an error indication indicating that there is an abnormality in the liquid discharge head 83, and thus this flow is complete. As in step S142, the control section 90*b* may provide the administrator of the printing apparatus 100*b* with, together with the error indication, an automatic notification that there is an abnormality in the printing apparatus 100*b*. If it is determined that there is not a dot omission (S240: NO), the process proceeds to step S244. In step S244, the control section 90*b* controls the cooler 68 of the temperature adjustment section 74 to cool the high temperature marker 66. At this point, a target temperature to which the high temperature marker 66 is to be decreased is 5° C., which is the high-temperature second threshold temperature TT22 of the high temperature marker 66. Thereby, in the high temperature marker 66 of the high-temperature second color state CH22, the color state is changed to the high-temperature first color state CH21, which is transparent, and this flow is complete.

As described above, according to the method for managing the printing apparatus 100*b* performed by the control section 90*b* according to the present embodiment, the printing apparatus 100*b* verifies the color state of each of the markers 62, 66 and, from a result of the verification, verifies whether there is a dot omission of the liquid discharge head 83. The user may detect whether there is an abnormality in the printing apparatus 100*b*, without visually recognizing each of the markers 62, 66. Accordingly, a problem that has occurred in the printing apparatus 100*b* by the past exposure of the printing apparatus 100*b* to a temperature outside the storage environment temperature range may be discovered early.

In the printing apparatus 100*b* according to the present embodiment, depending on a temperature change, the low temperature marker 62 reversibly changes between the low-temperature first color state CL11 and the low-temperature second color state CL12. Accordingly, after verifying with the low temperature marker 62 whether the printing apparatus 100*b* is exposed to a temperature outside the storage environment temperature range, raising the temperature of the low temperature marker 62 by the heater 64 causes the low temperature marker 62 to be returned to the color state before changing. Thereby, the low temperature marker 62 may be used again.

With the printing apparatus 100*b* according to the present embodiment, the low-temperature second threshold temperature TT12 is set at a temperature lower than the upper limit value TK2 of the nominal storage environment temperature. Therefore, without exposing the printing apparatus 100*b* to a temperature outside the nominal storage environment temperature range, the color state of the low temperature marker 62 may be changed from the low-temperature second color state CL12 to the low-temperature first color state CL11. Accordingly, by returning the color state of the low temperature marker 62 to the low-temperature first color state CL11 without exposing the printing apparatus 100*b* to a temperature outside the nominal storage environment temperature range, the low temperature marker 62 may be used again.

With the printing apparatus 100*b* according to the present embodiment, the low-temperature second threshold temperature TT12 is set at a temperature higher than 35° C. and lower than 40° C. This may effectively change the color state of the low temperature marker 62 while reducing the effects on the components of the printing apparatus 100*b*.

In the printing apparatus 100*b* according to the present embodiment, depending on a temperature change, the high temperature marker 66 reversibly changes between the high-temperature second color state CH22 and the high-temperature first color state CH21. Accordingly, after verifying whether the printing apparatus 100*b* is exposed to a temperature outside the storage environment temperature range, decreasing the temperature of the high temperature marker 66 by the cooler 68 causes the color state of the high temperature marker 66 to be returned to a color state before changing. Thereby, the high temperature marker 66 may be used again.

With the printing apparatus 100*b* according to the present embodiment, the high-temperature second threshold temperature TT22 is set at a temperature higher than the lower limit value TK1 of the nominal storage environment temperature. Therefore, without exposing the printing apparatus 100*b* to a temperature outside the nominal storage environment temperature range, the color state of the high temperature marker 66 may be changed from the high-temperature second color state CH22 to the high-temperature first color state CH21. Accordingly, without exposing the printing apparatus 100*b* to a temperature outside the nominal storage environment temperature, the color state of the high temperature marker 66 is returned to the high-temperature first color state CH21 and thus the high temperature marker 66 may be used again.

With the printing apparatus 100*b* according to the present embodiment, the high-temperature second threshold temperature TT22 is a temperature lower than 10° C. and higher than 0° C. This may effectively change the color state of the high temperature marker 66 while reducing the effects on the components of the printing apparatus 100*b*.

With the printing apparatus 100*b* according to the present embodiment, the low-temperature second threshold temperature TT12 of the low temperature marker 62 is set to be lower than the high-temperature first threshold temperature TT21 of the high temperature marker 66. Thereby, in raising the temperature of the low temperature marker 62 by the heater 64, the color state of the high temperature marker 66, which is adjacent to the low temperature marker 62, may be inhibited from changing to the high-temperature second color state CH22. Similarly, the high-temperature second threshold temperature TT22 of the high temperature marker 66 is set to be higher than the low-temperature first threshold temperature TT11 of the low temperature marker 62. Thereby, in decreasing the temperature of the high temperature marker 66 by the cooler 68, the color state of the low temperature marker 62, which is adjacent to the high temperature marker 66, may be inhibited from changing to the low-temperature second color state CL12.

C. Other Embodiments (C1) In the foregoing first embodiment, the color state display section 60 is attached onto the front surface of the housing 56 of the printing apparatus 100 by the sealing sheet SS. In the foregoing second embodiment, the color state display section 60*b* is disposed on the surface of the temperature adjustment section 74 inside the housing 56 of the printing apparatus 100*b*. However, a color state display section may be attached at any location of a printing apparatus. For example, placing the surface with the markers 62, 66 at a location where temperature management is to be performed in the printing apparatus 100, such as attaching the surface at a location in the side surface of the head unit 80, may enhance the accuracy of detection of a problem of each component. The sealing sheet SS and the temperature adjustment section 74 may be attached onto the housing 56 by paste or the like, may be attached by a magnet or the like, and may be disposed inside a case included in advance in the housing 56.

(C2) Although, in the foregoing second embodiment, in step S140, step S240, it is determined whether there is a dot omission in the liquid discharge head 83, abnormality detection is not limited to this. For example, an abnormality may be detected in components other than the liquid discharge head 83, such as each driving section in the printing apparatus 100*b* and the control section 90*b*.

(C3) Although, in the foregoing first embodiment, the low temperature marker 62 is made of a reversible thermochromic ink, the low temperature marker 62 is not limited to this. In the case where the low temperature marker 62 indicates the low-temperature first color state CL11, which is the initial state, at a temperature higher than the low-temperature first threshold temperature TT11, when, after reaching a temperature lower than or equal to the low-temperature first threshold temperature TT11, reaching a temperature higher than the low-temperature first threshold temperature TT11, the low temperature marker 62 may at least indicate the low-temperature second color state CL12, and may be made of a reversible thermochromic ink that does not allow for a reversible change to the low-temperature first color state CL11 due to a later temperature change.

(C4) Although, in the foregoing first embodiment, the high temperature marker 66 is made of a reversible thermochromic ink, the high temperature marker 66 is not limited to this. In the case where the high temperature marker 66 indicates the high-temperature first color state CH21, which is the initial state, at a temperature lower than the high-temperature first threshold temperature TT21, when, after reaching a temperature higher than or equal to the high-temperature first threshold temperature TT21, reaching a temperature lower than the high-temperature first threshold temperature TT21, the high temperature marker 66 may at least indicate the high-temperature second color state CH22, and may be made of a reversible thermochromic ink that does not allow for a reversible change to the high-temperature first color state CH21 due to a later temperature change.

(C5) Although, in the foregoing embodiments, the low-temperature first threshold temperature TT11 is −5° C., which is set to be lower than the lower limit value TK1 (0° C.) of the storage environment temperature, the low-temperature first threshold temperature TT11 is not limited to this and may be set at any temperature other than −5° C. The low-temperature first threshold temperature TT11 may be set to be higher than the lower limit value TK1 (0° C.) of the storage environment temperature.

(C6) Although, in the foregoing embodiments, the low-temperature second threshold temperature TT12 is 37° C., which is set to be higher than the upper limit value TW2 (35° C.) of the operating environment temperature and to be lower than the upper limit value TK2 (40° C.) of the storage environment temperature. However, the low-temperature second threshold temperature TT12 may not be 37° C., and may be lower than the upper limit value TW2 (35° C.) of the operating environment temperature and may be higher than the upper limit value TK2 (40° C.) of the storage environment temperature.

(C7) Although, in the foregoing embodiments, the high-temperature first threshold temperature TT21 is 45° C., which is set to be higher than the upper limit value TK2 (40° C.) of the storage environment temperature, the high-temperature first threshold temperature TT21 is not limited to this, may not be 45° C., and may be set to be lower than the upper limit value TK2 (40° C.) of the storage environment temperature.

(C8) Although, in the foregoing embodiments, the high-temperature second threshold temperature TT22 is 5° C. and is set to be lower than the lower limit value TW1 (10° C.) of the operating environment temperature and be higher than the lower limit value TK1 (0° C.) of the storage environment temperature. However, the high-temperature second threshold temperature TT22 may not be 5° C. and may be set to be at a temperature higher than the lower limit value TW1 (10° C.) of the operating environment temperature and to be at a temperature lower than the lower limit value TK1 (0° C.) of the storage environment temperature.

(C9) Although, in the foregoing embodiments, depending on a change in temperature, the low temperature marker 62 reversibly changes the color state between the low-temperature first color state CL11 indicating transparency and the low-temperature second color state CL12 indicating blue. However, the color states of the low-temperature first color state CL11 and the low-temperature second color state CL12 are not limited to blue and transparency but may be set in any color, such as orange, red, pink, violet, blue, green, brown, and black, and may also be a combination of transparency and nonwhite as well as a combination of nonwhite and nonwhite. The same applies to the high temperature marker 66. In such cases, the color state may be highly visible to the user, and the color state may be identified by the color state determination section 94.

(C10) Although, in the foregoing each embodiment, the color state display section 60, 60*b* includes two kinds of markers, the low temperature marker 62 and the high temperature marker 66, the color state display section 60, 60*b* may be in such a manner as to include either of the markers.

(C11) Although, in the foregoing second embodiment, the color state determination section 94 binarizes images of the low temperature marker 62 and the high temperature marker 66, detects respective edges of the markers 62, 66, and determines the color states, the way to detect the color states is not limited to this and the respective color states of the markers 62, 66 may be detected by various ways, such as infrared rays and optical detection, as well as detection of the respective color densities of the markers 62, 66, and detection of the color densities, brightnesses, colorfulnesses, and hues.

D. Other Aspects

The present disclosure is not limited to the foregoing embodiments and may be implemented in various aspects without departing from the spirit and scope thereof. For example, the present disclosure may be implemented in the aspects described below. The technical features of the foregoing embodiments corresponding to the technical features in each aspect described below may be appropriately replaced and combined in order to solve part or all of the problems of the present disclosure or to achieve part or all of the effects of the present disclosure. In addition, the technical features may be removed unless they are not described as being essential herein.

(1) According to an aspect of the present disclosure, a recording apparatus that performs recording on a recording medium is provided. This recording apparatus includes a low temperature marker that, depending on a change in temperature, changes a color state to a low-temperature first color state or to a low-temperature second color state different from the low-temperature first color state, and a surface on which the low temperature marker is disposed. When the low temperature marker reaches a temperature lower than or equal to a low-temperature first threshold temperature from the initial state indicating the low-temperature first color state, the low temperature marker may have a characteristic of indicating the low-temperature second color state at a temperature higher than at least the low-temperature first threshold temperature. With the recording apparatus according to this aspect, when the low temperature marker, which has indicated the low-temperature first color state at a temperature higher than the low-temperature first threshold temperature, indicates the low-temperature second color state when, after reaching a temperature lower than or equal to the low-temperature first threshold temperature, reaching a temperature higher than the low-temperature first threshold temperature. Thereby, by using the color state of the low temperature marker, the user may visually recognize a change in the environment temperature in the past of decreasing below the low-temperature first threshold temperature on the low temperature side.

(2) In the recording apparatus according to the aspect mentioned above, the low temperature marker in the low-temperature second color state may have a characteristic of indicating the low-temperature first color state when the low temperature marker further reaches a temperature higher than or equal to a low-temperature second threshold temperature determined in advance as a temperature higher than the low-temperature first threshold temperature, and indicating the low-temperature first color state when, after reaching a temperature higher than or equal to the low-temperature second threshold temperature, the low temperature marker reaches a temperature lower than the low-temperature second threshold temperature. With the recording apparatus according to this aspect, depending on a change in temperature, the low temperature marker reversibly changes between the low-temperature first color state and the low-temperature second color state. Accordingly, raising the temperature of the low temperature marker causes the color state to be returned to a color state before changing. Thereby, the low temperature marker may be used again.

(3) In the recording apparatus according to the aspect, the low-temperature second threshold temperature may be a temperature higher than an upper limit value of a nominal operating environment temperature of the recording apparatus and lower than an upper limit value of a nominal storage environment temperature of the recording apparatus. With the recording apparatus according to this aspect, since the low-temperature second threshold temperature is set higher than the upper limit value of the nominal operating environment temperature of the recording apparatus, a problem in which the color state of the low temperature marker changes while the recording apparatus is within the range of the nominal operating environment temperature, that is, while the recording apparatus is in operation may be avoided. Since the low-temperature second threshold temperature is set at a temperature lower than the upper limit value of the nominal storage environment temperature, the color state of the low temperature marker may be changed from the low-temperature second color state to the low-temperature first color state without exposing the recording apparatus to a temperature outside the nominal storage environment temperature range. Accordingly, by returning the color state of the low temperature marker to the low-temperature first color state without exposing the recording apparatus to a temperature outside the nominal storage environment temperature range, the low temperature marker may be used again.

(4) In the recording apparatus according to the aspect, the low-temperature second threshold temperature may be a temperature higher than 35° C. and lower than 40° C. The recording apparatus according to this aspect may effectively change the color state of the low temperature marker while reducing the effects on the components of the recording apparatus.

(5) In the recording apparatus according to the aspect, the low-temperature first threshold temperature is a temperature lower than the lower limit value of the nominal storage environment temperature of the recording apparatus. Thereby, by using a marker, the user may visually recognize a change in the environment temperature in the past of decreasing below the lower limit value of the nominal storage environment temperature.

(6) In the recording apparatus according to the aspect, the low-temperature first threshold temperature is a temperature lower than 0° C. With the recording apparatus according to this aspect, by using a marker, the user may visually recognize that the recording apparatus is exposed to a low temperature that is highly likely to affect the recording apparatus.

(7) According to an aspect of the present disclosure, a recording apparatus that performs recording on a recording medium is provided. This recording apparatus includes a high temperature marker that, depending on a change in temperature, changes a color state to a high-temperature first color state or to a high-temperature second color state different from the high-temperature first color state, and a surface on which the high temperature marker is disposed. When the high temperature marker reaches a temperature higher than or equal to a high-temperature first threshold temperature from an initial state indicating the high-temperature first color state, the high temperature marker has a characteristic of indicating the high-temperature second color state at a temperature lower than at least the high-temperature first threshold temperature. Thereby, by using the high temperature marker, the user may visually recognize a change in the environment temperature in the past of rising above the high-temperature first threshold temperature on the high temperature side.

(8) In the recording apparatus according to the aspect, the high temperature marker in the high-temperature second color state may have a characteristic of indicating the high-temperature first color state when the high temperature marker reaches a temperature lower than or equal to a high-temperature second threshold temperature determined in advance as a temperature lower than the high-temperature first threshold temperature, and indicating the high-temperature first color state when, after reaching a temperature lower than or equal to the high-temperature second threshold temperature, the high temperature marker reaches a temperature higher than the high-temperature second threshold temperature. Accordingly, by decreasing the temperature of the high temperature marker, the color state of the high temperature marker is returned to the state before changing, and thereby the high temperature marker may be used again.

(9) In the recording apparatus according to the aspect, the high-temperature second threshold temperature may be a temperature lower than a lower limit value of a nominal operating environment temperature of the recording apparatus and higher than a lower limit value of a nominal storage environment temperature of the recording apparatus. With the recording apparatus according to this aspect, since the high-temperature second threshold temperature is set as a temperature lower than the lower limit value of the nominal operating environment temperature of the recording apparatus, a problem in which the color state of the high temperature marker changes while the recording apparatus is within the range of the nominal operating environment temperature, that is, while the recording apparatus is in operation may be avoided. Since the high-temperature second threshold temperature is set at a temperature higher than the lower limit value of the nominal storage environment temperature, the color state of the high temperature marker may be changed from the high-temperature second color state to the high-temperature first color state without exposing the recording apparatus to a temperature outside the nominal storage environment temperature range. Accordingly, by returning the color state of the high temperature marker to the high-temperature first color state without exposing the recording apparatus to a temperature outside the nominal storage environment temperature range, the high temperature marker may be used again.

(10) In the recording apparatus according to the aspect, the high-temperature second threshold temperature may be a temperature lower than 10° C. and higher than 0° C. The recording apparatus according to this aspect may effectively change the color state of the high temperature marker while reducing the effects on the components of the recording apparatus.

(11) In the recording apparatus according to the aspect, the high-temperature first threshold temperature may be a temperature higher than an upper limit value of a nominal storage environment temperature. Thereby, by using the high temperature marker, the user may visually recognize a change in the environment temperature in the past of rising above the upper limit value of the nominal storage environment temperature.

(12) In the recording apparatus according to the aspect, the high-temperature first threshold temperature may be a temperature higher than 40° C. With the recording apparatus according to this aspect, by using a marker, the user may visually recognize that the recording apparatus is exposed to a high temperature that is highly likely to affect the recording apparatus.

(13) According to another aspect of the present disclosure, a method for managing a recording apparatus that performs recording on a recording medium is provided. The method for managing a recording apparatus obtains a color state of a marker that, depending on a change in temperature, changes the color state to a first color state or to a second color state different from the first color state, the marker having a characteristic of indicating the second color state when, in a case in which the marker indicates the first color state at a temperature higher than a first threshold temperature set in advance, after reaching a temperature lower than or equal to the first threshold temperature, the marker reaches a temperature higher than the first threshold temperature. The method determines, from the obtained color state, whether there is a change in the color state of the marker. When it is determined that there is a change in the color state, the method performs test recording on the recording medium. The method determines, from a result of the test recording, whether there is an abnormality in the recording apparatus. When it is determined, from the result, that there is an abnormality in the recording apparatus, the method issues a notification of the abnormality in the recording apparatus. When it is determined, from the result, that there is not an abnormality in the recording apparatus, the method adjusts temperature of the marker to change the changed color state of the marker to a color state before changing. According to the method for managing a recording apparatus according to this aspect, a marker, which has indicated the first color state at a temperature higher than the first threshold temperature, indicates the second color state when, after reaching a temperature lower than or equal to the first threshold temperature, reaching a temperature higher than the first threshold temperature. The recording apparatus recognizes the color state of the marker and, if desired in response to a change in the color state, may verify whether there is an abnormality in the recording apparatus. Without visually verifying a marker, the user may know whether there is an abnormality in the recording apparatus and may early discover a problem in the recording apparatus.

The present disclosure may be implemented in various forms other than the recording apparatus. For example, the present disclosure may be implemented in forms, such as a manufacturing method for a recording apparatus and a controlling method for a recording apparatus, a computer program of implementing the controlling method, and a non-transitory recording medium on which the computer program is recorded.

What is claimed is:

1. A recording apparatus that performs recording on a recording medium, comprising:

a low temperature marker that, depending on a change in temperature, changes a color state to a low-temperature first color state or to a low-temperature second color state different from the low-temperature first color state; and a surface on which the low temperature marker is disposed, wherein the low temperature marker has a characteristic of indicating the low-temperature second color state when a temperature of the low temperature marker is higher than at least the low-temperature first threshold temperature after reached a temperature lower than or equal to a low-temperature first threshold temperature from an initial state indicating the low temperature first color state.

2. The recording apparatus according to claim 1, wherein the low temperature marker further has a characteristic of indicating the low-temperature first color state when the low temperature marker in the low temperature second color state further reaches a temperature higher than or equal to a low-temperature second threshold temperature determined in advance as a temperature higher than the low-temperature first threshold temperature, and indicating the low-temperature first color state when, after reaching a temperature higher than or equal to the low-temperature second threshold temperature, the low temperature marker reaches a temperature lower than the low-temperature second threshold temperature.

3. The recording apparatus according to claim 2, wherein the low-temperature second threshold temperature is a temperature higher than an upper limit value of a nominal operating environment temperature of the recording apparatus and lower than an upper limit value of a nominal storage environment temperature of the recording apparatus.

4. The recording apparatus according to claim 2, wherein the low-temperature second threshold temperature is a temperature higher than 35° C. and lower than 40° C.

5. The recording apparatus according to claim 1, wherein the low-temperature first threshold temperature is a temperature lower than a lower limit value of a nominal storage environment temperature of the recording apparatus.

6. The recording apparatus according to claim 1, wherein the low-temperature first threshold temperature is a temperature lower than 0° C.

7. A recording apparatus that performs recording on a recording medium, comprising:

a high temperature marker that, depending on a change in temperature, changes a color state to a high-temperature first color state or to a high-temperature second color state different from the high-temperature first color state; and a surface on which the high temperature marker is disposed, wherein the high temperature marker has a characteristic of indicating the high-temperature second color state when a temperature of the high temperature marker is lower than at least the high-temperature first threshold temperature after reached a temperature higher than or equal to the high temperature first threshold temperature from an initial state indicating the high temperature first color state.

8. The recording apparatus according to claim 7, wherein the high temperature marker further has a characteristic of indicating the high-temperature first color state when the high temperature marker in the high-temperature second color state reaches a temperature lower than or equal to a high-temperature second threshold temperature determined in advance as a temperature lower than the high-temperature first threshold temperature, and indicating the high-temperature first color state when, after reaching a temperature lower than or equal to the high-temperature second threshold temperature, the high temperature marker reaches a temperature higher than the high-temperature second threshold temperature.

9. The recording apparatus according to claim 8, wherein the high-temperature second threshold temperature is a temperature lower than a lower limit value of a nominal operating environment temperature of the recording apparatus and higher than a lower limit value of a nominal storage environment temperature of the recording apparatus.

10. The recording apparatus according to claim 8, wherein the high-temperature second threshold temperature is lower than 10° C. and higher than 0° C.

11. The recording apparatus according to claim 7, wherein the high-temperature first threshold temperature is a temperature higher than an upper limit value of a nominal storage environment temperature of the recording apparatus.

12. The recording apparatus according to claim 7, wherein the high-temperature first threshold temperature is a temperature higher than 40° C.

13. A method for managing a recording apparatus that performs recording on a recording medium; comprising:

obtaining a color state of a marker that, depending on a change in temperature, changes the color state to a first color state or to a second color state different from the first color state, the marker having a characteristic of indicating the second color state when a temperature of the marker is higher than a first threshold temperature set in advance, after the marker in the first color state reaches a temperature lower than or equal to the first threshold temperature;

determining, from the obtained color state, whether there is a change in the color state of the marker;

when it is determined that there is a change in the color state, performing test recording on the recording medium;

determining, from a result of the test recording, whether there is an abnormality in the recording apparatus; and when it is determined, from the result, that there is an abnormality in the recording apparatus, issuing a notification of the abnormality in the recording apparatus, and when it is determined, from the result, that there is not an abnormality in the recording apparatus, adjusting temperature of the marker to change the changed color state of the marker to a color state before changing.

* * * * *